US011000128B2

(12) United States Patent
Frankel et al.

(10) Patent No.: US 11,000,128 B2
(45) Date of Patent: May 11, 2021

(54) HORIZONTAL-MOVING AND ROCKING APPLIANCE AND ROCKING CHAIR

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 107 days.

(21) Appl. No.: 16/523,676

(22) Filed: Jul. 26, 2019

(65) Prior Publication Data

US 2021/0022508 A1 Jan. 28, 2021

(51) Int. Cl.
*A47C 3/03* (2006.01)

(52) U.S. Cl.
CPC ..... *A47C 3/03* (2013.01)

(58) Field of Classification Search
None
See application file for complete search history.

(56) References Cited

U.S. PATENT DOCUMENTS 3,999,799 A * 12/1976 Daswick ..... A47C 3/0257 297/270.3
5,375,911 A * 12/1994 Morrow ..... A47C 3/029 297/271.5
5,860,698 A * 1/1999 Asenstorfer ..... A47D 9/04 297/217.4
7,537,285 B2 * 5/2009 Stewart ..... A47C 3/029 297/130
10,448,740 B1 * 10/2019 Frankel ..... A47C 4/28
10,568,430 B1 * 2/2020 Sun ..... A47C 3/025
2009/0200846 A1 * 8/2009 Yehuda ..... A47D 9/04 297/271.5
2012/0022412 A1 * 1/2012 Bryant ..... A47C 7/50 601/24
2012/0212022 A1 * 8/2012 Godbout ..... A47C 3/0251 297/260.2
2014/0097647 A1 * 4/2014 Grace ..... A47C 3/027 297/42
2019/0110599 A1 * 4/2019 Grace ..... A47C 7/443
2019/0246797 A1 * 8/2019 Shih ..... A47C 3/0251
2019/0298064 A1 * 10/2019 Shih ..... A47C 3/027

* cited by examiner

*Primary Examiner* — David E Allred
(74) *Attorney, Agent, or Firm* — Merek, Blackmon & Voorhees, LLC

(57) ABSTRACT

A horizontal moving & rocking appliance and chair includes a ground piece, mid and rear rollers eccentrically positioned at a mid and rear ends of ground pieces, synchronous link rods hinged between mid and rear rollers. In stationary state, the mid roller positioning shaft is in a forward rolling lower position while the rear roller positioning shaft is in a backward rolling higher position, and these together with the fore ends of ground pieces form a three-ground point; A horizontal moving & rocking chair includes a chair and horizontal moving & rocking appliance mounted on both sides of legs.

6 Claims, 6 Drawing Sheets

HORIZONTAL-MOVING AND ROCKING APPLIANCE AND ROCKING CHAIR

BACKGROUND OF THE INVENTION

Field of the Invention

This invention relates to a horizontal-moving & rocking appliance for rocking chairs. The appliance is especially fitted for common chairs, realizing backward movement of load center to generate rocking function.

Technical Background

Conventional rocking chairs feature curved ground pieces for support and smooth rocking. However, these curved pieces often extend beyond the load center for safety reasons and rocking chairs are always unstable suited only for casual occasions. To this end, people in the industry have also made various improvements in order to make a rocking chair that has a smaller size and that is relatively stable and controllable.

For example, patent 201620946307.5 shows a dual-purpose chair with four legs. Two legs at the bottom of each side are connected together as a rocking piece, at center of which comes a connecting seat, namely, the swinging pivot. A supporting piece joints into this swinging pivot and extends backward to the ground. A resilience piece is hinged between rear end of supporting piece and mid-upper part of rear legs or back of chair and can be compressed when its load center moves backwards or the human body leans back. At this point, the chair will move backward around swinging pivot and the front legs will move upwardly to leave the ground; The counter force will increase gradually while pressure is applied to the resilient piece to the limit. With people's forward thought, the rocking chair will move forward and bounce back to its original position under elastic force. Under control of human thought, the front legs extend down to the ground and the resilient piece compresses to the limit make chair rocking back and forth. Additionally, the rocking chair remains stable because of the slightly forward load center after being seated. This also has the advantage of a dual-purpose chair.

SUMMARY OF THE INVENTION

An objective of this invention is to design a horizontal moving and rocking device, which, with two rollers positioned eccentrically in the middle and rear of the ground pieces, enables horizontal motion of ground pieces as well as makes ground pieces follow the rollers for eccentric rocking, and a design of a rocking chair with this device.

The technical proposal of the invention is achieved in one or more of the following ways:

A horizontal moving and rocking appliance features:

Ground pieces to carry load;

Mid roller positioned eccentrically at mid of ground pieces as swinging fulcrum;

Rear roller positioned eccentrically at rear of ground pieces as rear fulcrum;

Synchronous linking rod articulated between the mid and the rear rollers to maintain two rollers working synchronously.

In stationary state, positioning shaft of mid roller is located at forward rolling lower position and that of rear roller at backward rolling higher position, these 2 positions together with fore-end of ground piece form 3 ground points;

In motion state, the load center of ground pieces will move backward with load, mid roller will move forward at higher position to form a swinging fulcrum while rear roller will move backward at lower position, at the same time, rear-end of ground piece settles and fore-end tilts up; So, ground pieces will follow load center of load to move back and forth horizontally and rock around mid rollers.

Synchronous rods are connected to the same sides of mid and rear rollers by means of articulation, and rods with limit gears on them work together to limit travel distance of mid and rear rollers.

The limit gears can be one of the following: 1) mid and rear rollers feature indented sides and synchronous rods hinged to lower position side can be stopped by indented sides when in relative rotation; and 2) to lock up the synchronous rods or to stop the synchronous rods with the aid of extruded pins formed on sides of both mid and rear roller.

Installed in between mid rollers and ground pieces are reset springs that constantly bias mid rollers to move towards lower position.

The reset spring is a torsion spring, sleeved on a positioning shaft between the mid rollers and the grounding pieces, and can sink into the recessed space on the sides of mid rollers.

A horizontal moving & rocking chair includes one or more of the above-mentioned horizontal moving & rocking appliance and chair, featuring that at both sides of the chair, at least the fore-legs are fixed to the front ends of ground pieces and both sides of the ground pieces are in parallel; the designed load center of the chair locates within 100 mm before mid rollers while the space is over 50 mm in between mid and rear rollers.

The ground pieces are formed by bending the fore-legs backward and being a part of the same side.

The rear legs or the back side supporting pieces are hinged on the ground pieces before the rear rollers.

The ground pieces are formed by bending the fore-legs backward and being a part of the same side; and both sides of ground pieces are connected together at rear ends.

The fore and rear legs are fixed on the respective fore and rear ends of the corresponding ground pieces and the fore or rear ends of the ground pieces are connected together, or the ground pieces at both sides are a complete whole piece bent into U-shape.

This invention features ingenious design, simple structure, reasonable design and easy rocking, in particular, the ground pieces utilize three-point support, and load center faces forward when seated so that the chair is in a stable state, keeping your sitting posture dignified and conforming to a business environment; the consciously stepping makes people's weight move backwards so that the supporting points at fore end of the ground pieces are suspended, the mid and rear rollers move backwards synchronously. In this way, the chair is able to horizontally move backwards and then rocks up and down. The chair enjoys two states.

BRIEF DESCRIPTION OF THE DRAWINGS

Similar reference characters denote corresponding features consistently throughout the attached drawings. Namely, in the drawings the following reference numbers refer to the following part.

1—Ground Piece
11—Positioning Shaft
12—Cross Piece
2—Mid Roller
21—Indented Side
22—Recessed Space
3—Rear Roller
4—Synchronous Link Rod
5—Reset Spring
6—Chair
61—Fore Leg
62—Rear Leg
63—Supporting Piece
A—Roller Center

DETAILED DESCRIPTION OF THE PREFERRED EMBODIMENT(S)

Figure 3:
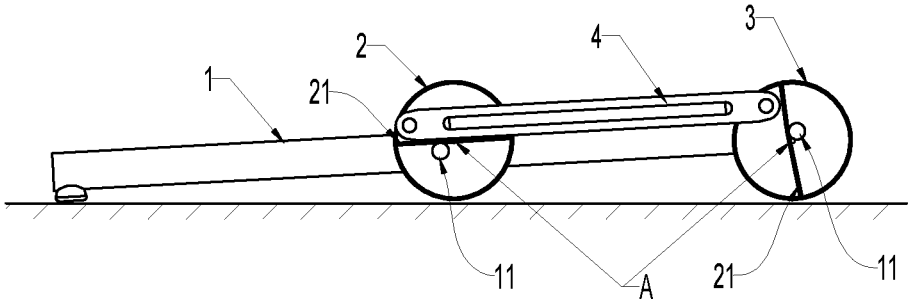
FIG. 3 is a side view of the Appliance in a Stationary State
Figure 4:
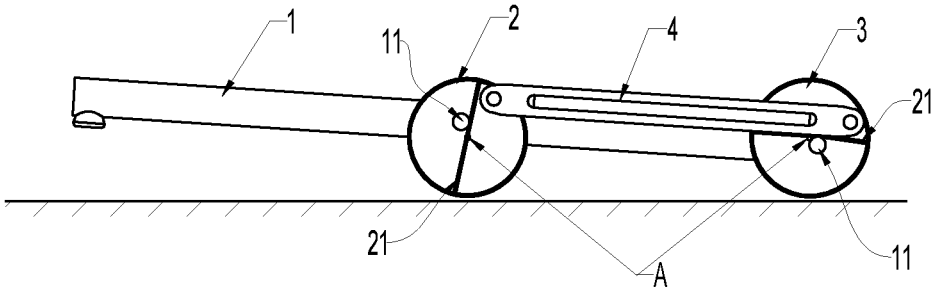
FIG. 4 is a side view of the Appliance in a Backward Limit State

This application refers to "rolling forward at higher and lower positions, rolling backward at higher and lower positions", the explanation of which is as follows: due to eccentric rolling motion a rocking chair is in an unstable state when an eccentric positioning shaft is right above roller center and tends to move forward; so this tendency is referred to as "rolling forward." When eccentric positioning shaft tends to move backward, it is referred to as "rolling backward." Hereinunder, the "higher position" is relative to the "lower position", referring to the height of eccentric positioning shaft relative to the roller center, and used to express if the rolling tendency is from a higher position to a lower position and vice versa. As shown in FIGS. 3 and 4, the position of roller center A is a function of the eccentric positioning shaft 11.

Figure 1:
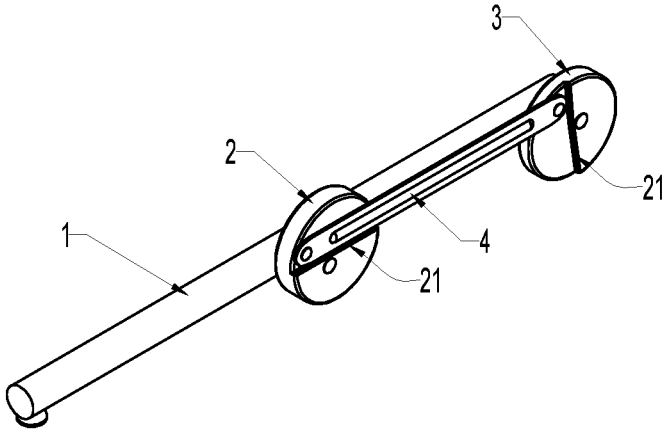
FIG. 1 is a perspective view of a Horizontal Moving & Rocking Appliance according to the invention.
Figure 2:
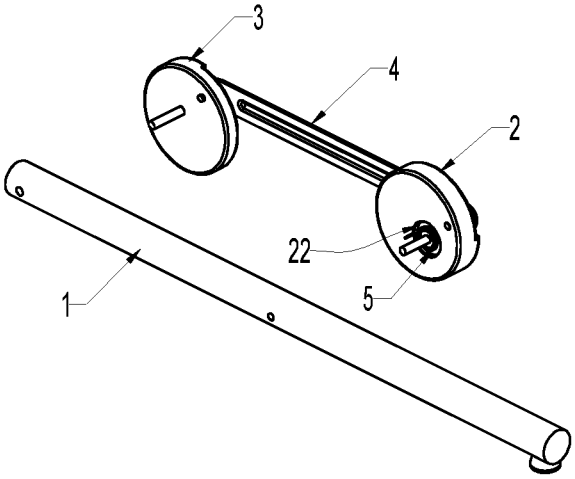
FIG. 2 is an exploded view of the Appliance Details for the invention.

FIGS. 1 and 4 refer to horizontal moving & rocking appliance, comprised of a ground piece 1 to carry load, mid roller 2 and rear roller 3 eccentrically fixed on mid and rear part of the ground piece, synchronous link rod 4 to retain mid roller 2 and rear roller 3 for synchronously motion. The steady state of design is the stationary state, in which, the eccentric positioning shaft of mid roller 2 is at a lower position, tending to roll forward while the eccentric positioning shaft of rear roller 3 is at a higher position, tending to roll backward, and these together with fore end of ground piece 1 form a 3-ground point, meaning designed load center is located before mid roller 2, as shown in FIG. 3.

In motion, ground piece 1 moves backwards along with the load center. More precisely, when load center shifts to mid roller 2, the mid roller 2 rotates forward at a higher position to form a swing fulcrum while rear roller 3 rotates backward at a lower position so that rear end of ground piece 1 settles and fore end tilts up to realize backward moving plus rocking motion, and ground piece 1 moves horizontally back and forth following movement of the load center. Moving backwards to limit position as shown in FIG. 4.

Synchronous link rod functions to restrain travel distance in addition to synchronizing the pace of mid roller 2 and rear roller 3. Synchronous rod 3 is connected to the same sides of mid roller 2 and rear roller 3 by means of articulation, and the rod 4 works together with limit gear on it to restrain travel distance of mid roller 2 and rear roller 3. The limit gears can be one of the following: 1) mid roller 2 and rear roller 3 feature indented sides and synchronous rod 4 hinged to a lower position side can be stopped by indented side 21 when in relative rotation; and 2) to lock up the synchronous rod or to stop synchronous rod with the aid of extruded pins formed on sides of both mid roller 2 and rear roller 3, namely, to have the same function by use of a pin or screw fixed on the side.

In addition, a reset spring 5 is fixed in between mid roller 2 and ground piece 1 to retain mid roller's 2 tendency of rolling towards a lower position, in this way to restore to the initial design state. In this example, the reset spring 5 is a torsion spring sleeved on positioning shaft 11 between mid roller 2 and ground piece 1, and can settle into recessed space 22 on side of mid roller 2 without affecting its look. Also, a tension spring may be used. In addition, the same reset spring may be provided between rear roller 3 and ground piece 1 as needed to increase restoring force.

The aforesaid horizontal moving & rocking appliance may be installed in chairs to take advantage of this function. Based on different functions and construction of chair 6 itself, the horizontal moving & rocking appliance can be integrated into chairs for an integrated design, or mechanically added, so that chair enjoys horizontal moving & rocking function. Typical application examples are as follows.

A horizontal moving & rocking chair includes a horizontal moving & rocking appliance and chair 6, featuring that at both sides of the chair, at least fore-legs 61 are fixed to the fore ends of ground pieces 1 and both sides of the ground pieces are in parallel; the designed load center of chair 6 locates within 100 mm before mid rollers 2 while the space is over 50 mm in between mid roller 2 and rear roller 3.

Figure 5:
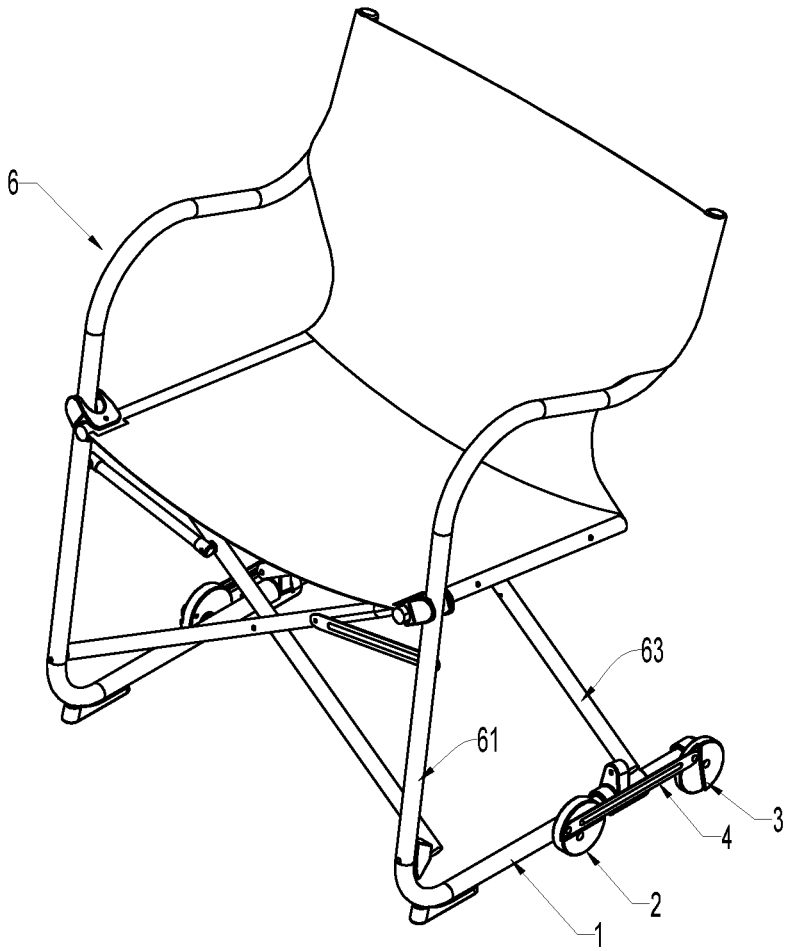
FIG. 5 is a perspective view of a Collapsible Rocking Chair with the appliance.

FIG. 5 refers to collapsible chair 6, in which, ground piece 1 is formed by bending fore leg 61 backward and being a part of the same side; supporting piece 63 at back side of chair 6 is hinged on ground piece 1 before rear roller 3, forming a closed left and right side and a collapsible construction.

Figure 6:
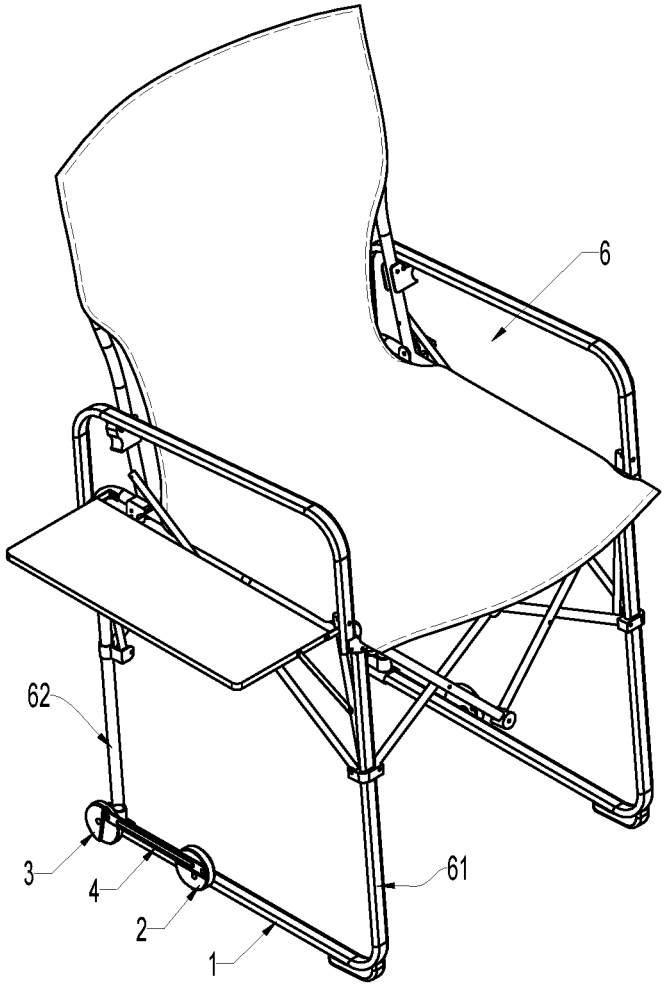
FIG. 6 is a perspective view of a Director's Rocking Chair with the appliance.

FIG. 6 refers to collapsible director chair 6, in which, ground piece 1 is formed by bending fore leg 61 backward and being a part of the same side; rear leg 62 at both sides of chair 6 is hinged on ground piece 1 before rear roller 3, forming a closed left and right sides and collapsible construction.

Figure 7:
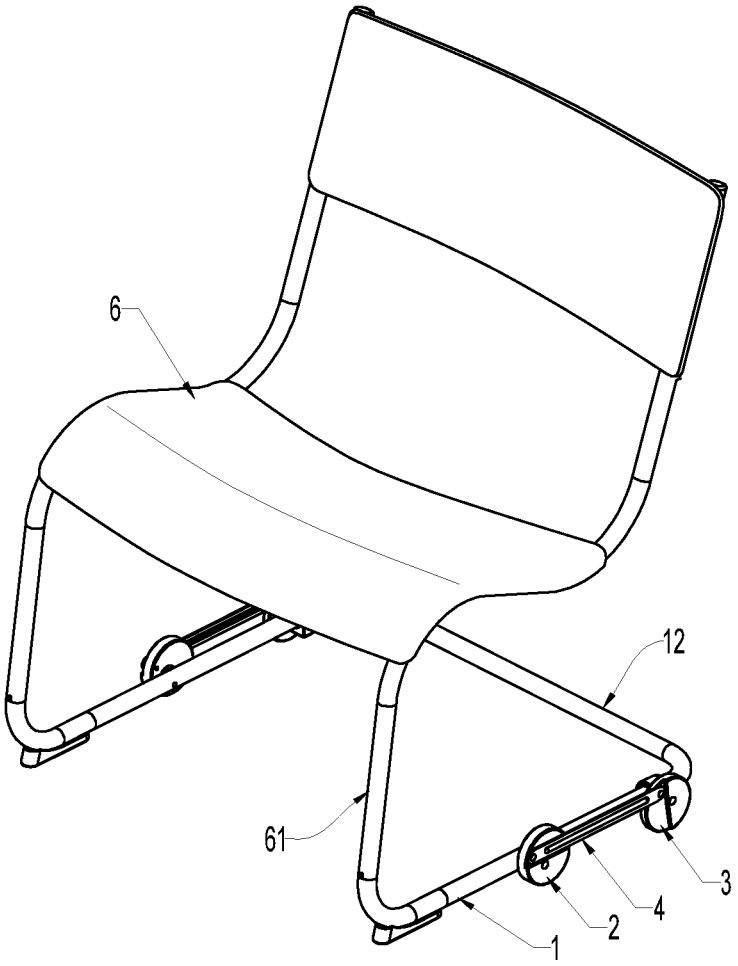
FIG. 7 is a perspective view of a Steel-Tube Rocking Chair with the appliance.

FIG. 7 refers to steel-tube chair 6, in which, ground piece 1 is formed by bending fore leg 61 backward and being a part of the same side; ground pieces 1 at back side are joined together at rear end with a cross piece 12, or to disconnect with a short U-shaped member.

Figure 8:
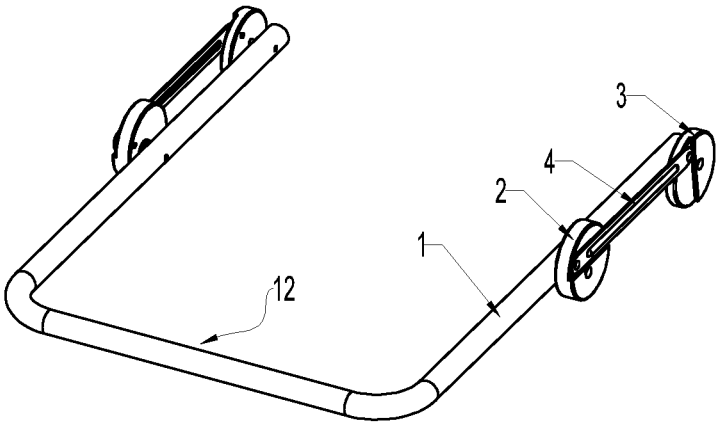
FIG. 8 is a break out view of a Rocking Support of the invention.

As shown in FIG. 8, two horizontal moving & rocking appliances are mounted on a frame, or the fore or rear ends of ground pieces 1 are connected to each other with a cross piece 12; the best proposal is as shown in the figure. ground pieces 1 at both sides are a complete whole piece and are in parallel by bending the piece into a U shape, which is simple and practical. A cross piece can also be connected to the U-shaped open end to form a frame with good rigidity to support the upper chair. To realize the chair's function of horizontal moving & rocking, it is only necessary to affix the fore and rear legs at both sides of chair 6 to the respective fore and rear ends of ground pieces 1.

This illustration is designed to show that horizontal moving & rocking appliance are applicable to all types of chairs, as long as the chair has four legs or has two connected sides, it can be mechanically placed on the frame combined with horizontal moving & rocking appliance, or design of horizontal moving & rocking appliance can be integrated as a part of support at both sides of the chair. In this way, it is able to realize both functions of stable seating and rocking motion, so that business and leisure are both possible.

We claim:

1. A horizontal moving and rocking appliance comprising:

at least one elongated ground piece configured to carry a load;

a mid roller rotatably and eccentrically mounted by a mid roller positioning shaft in a middle portion of the at least one ground piece to provide a swinging fulcrum;

a rear roller rotatably and eccentrically mounted by a rear roller positioning shaft at a rear portion of the at least one ground piece to provide a rear swinging stop;

a synchronous linking rod articulatingly connected to each of the mid roller and the rear roller to synchronize movement of the mid roller and the rear roller;

wherein the horizontal moving and rocking appliance is adjustable between at least a first stationary state and a second motion state;

wherein in the stationary state, the mid roller positioning shaft is located at a forward lower position relative to the mid roller such that the mid roller provides a medium height fulcrum, the rear roller positioning shaft is located at a rearward upper position relative to the rear roller such that the rear roller provides a greater height stop relative to the medium height fulcrum, and a forward end of the at least one elongated ground piece is at a lower height than the medium height fulcrum such that the forward end, the mid roller, and the rear roller are adapted to engage a ground in the stationary state;

wherein in the motion state, the mid roller positioning shaft is located at a forward upper position relative to the mid roller such that the mid roller provides a greater height fulcrum, the rear roller positioning shaft is located at a rearward lower position relative to the rear roller such that the rear roller provides a lower height stop relative to the greater height fulcrum, and a forward end of the at least one elongated ground piece is at a height greater than the greater height fulcrum; and wherein the at least one ground piece is adapted to be actuated by and follow movement of a load center as it moves back and forth along a length of the at least one ground piece and to rock around the fulcrum of the mid roller.

2. The appliance according to claim 1, wherein the synchronous linking rod is articulatingly connected to a first side of each of the mid roller and the rear roller, wherein the first sides of the mid roller and the rear roller includes blocking structure that engages the linking rod to limit travel distance of the mid roller and the rear roller.

3. The appliance according to claim 2, wherein the blocking structure comprises the mid roller and the rear roller each including indented portions on the first side and the linking rod hinged to the mid roller and the rear roller in the respective indented portions or the mid roller and the rear roller each including extruded pins formed on the first side of each of the mid roller and the rear roller such that the linking rod is blocked by the extruded pins at to limit the travel distance of the mid roller and the rear roller.

4. The appliance of claim 1, 2, or 3, wherein the horizontal moving and rocking appliance includes a reset spring that is interposed between the mid roller and the elongated ground piece, the reset spring urging the mid roller toward the stationary state.

5. The appliance according to claim 4, wherein the mid roller comprises a recess surrounding the mid roller positioning shaft, and wherein the reset spring is a torsion spring that is sleeved on the mid roller positioning shaft and received in the recess in the mid roller.

6. The appliance according to claim 1, 2, or 3, wherein the horizontal moving and rocking appliance comprises a plurality of elongated ground pieces configured to carry a load, including the at least one elongated ground piece.

* * * * *